US007021509B2

(12) United States Patent
Chuang

(10) Patent No.: US 7,021,509 B2
(45) Date of Patent: Apr. 4, 2006

(54) SAFETY BAG WITH FIRM STRUCTURE

(76) Inventor: Shin Hui Chuang, 235 Chung-Ho, Box 8-24, Taipei (TW)

( * ) Notice: Subject to any disclaimer, the term of this patent is extended or adjusted under 35 U.S.C. 154(b) by 84 days.

(21) Appl. No.: 10/601,297

(22) Filed: Jun. 23, 2003

(65) Prior Publication Data

US 2004/0256431 A1 Dec. 23, 2004

(51) Int. Cl.
*A45F 3/04* (2006.01)

(52) U.S. Cl. ..... 224/628; 224/653; 224/656; 224/659

(58) Field of Classification Search ..... 224/628, 224/629, 645, 153, 652, 606, 608, 616, 656, 224/659, 655, 653; 190/127
See application file for complete search history.

(56) References Cited

U.S. PATENT DOCUMENTS

D227,044 S * 5/1973 Camp ..... D7/709
3,902,640 A * 9/1975 Geiben ..... 224/629
4,094,351 A * 6/1978 Catenaccio ..... 224/609
5,012,964 A * 5/1991 Falletta et al. ..... 224/153
D390,352 S * 2/1998 Lane ..... D3/216
5,730,347 A * 3/1998 Finot ..... 224/631
6,179,186 B1 * 1/2001 Blanking ..... 224/629
D453,873 S * 2/2002 Blanking ..... D3/217
D460,614 S * 7/2002 Reimers et al. ..... D3/217
D461,048 S * 8/2002 Blanking ..... D3/216
6,629,629 B1 * 10/2003 Lee et al. ..... 224/583
6,658,704 B1 * 12/2003 Buscart ..... 24/115 G
6,659,320 B1 * 12/2003 Alves et al. ..... 224/581
6,769,585 B1 * 8/2004 Santaniello et al. ..... 224/629
2002/0020729 A1 * 2/2002 Alter ..... 224/629

* cited by examiner

*Primary Examiner*—Jes F. Pascua

(57) ABSTRACT

A safety bag with a firm structure is formed by connecting a hard casing and a soft enclosure. The connectors for connecting a cover extending from the soft enclosure and the hard casing are installed with a plurality of buckles. The cover is installed with a first insertion portion at a front surface of the bag and a second insertion portion at two sides of the bag. A band passes through the first insertion portion and second insertion portion. The band out of the first insertion portion and second insertion portion is tightened by the retaining ring. Two ends of the band are buckled to selective two buckled of the plurality of buckles. The band is capable of being buckled to the buckles of different levels so that the tightness of the cover securing to the hard casing is adjusted according to the objects in the bag.

1 Claim, 5 Drawing Sheets

SAFETY BAG WITH FIRM STRUCTURE

FIELD OF THE INVENTION

The present invention relates to bags, and particularly to a safety bag with a firm structure. The bag is formed by a hard casing and a soft enclosure. A band is used to buckle a cover to the opening of the bag firmly so that object in the bag will not fall out.

BACKGROUND OF THE INVENTION

Currently, for receiving notebooks, or communication devices or other portable electronic devices, bags are made of hard materials so as to protect the objects receiving therein.

In these kinds of bags, the upper sides of the bags have an opening and a cover is installed for covering the opening. The operation is performed by tightening one or two bands protruded from a front surface of the bag and then the bands are buckled to the buckles at the front surface. However, this prior art fixing way only fixes the front surface, but two sides of the bag are not fixed, and also they are opened at two sides so that objects in the bag possibly fall out from the opened sides.

SUMMARY OF THE INVENTION

Accordingly, the primary object of the present invention is to provide a safety bag with a firm structure which is formed by connecting a hard casing to a soft enclosure. The connectors for connecting a cover extending from the soft enclosure and the hard casing are installed with a plurality of buckles. The cover is installed with a first insertion portion at a front surface of the bag and a second insertion portion at two sides of the bag. A band passes through the first insertion portion and second insertion portion. The band out of the first insertion portion and second insertion portion is tightened by the retaining ring. Two ends of the band are buckled to selective two buckled of the plurality of buckles. The band is capable of being buckled to the buckles of different levels so that the tightness of the cover securing to the hard casing is adjustable according to the objects in the bag.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
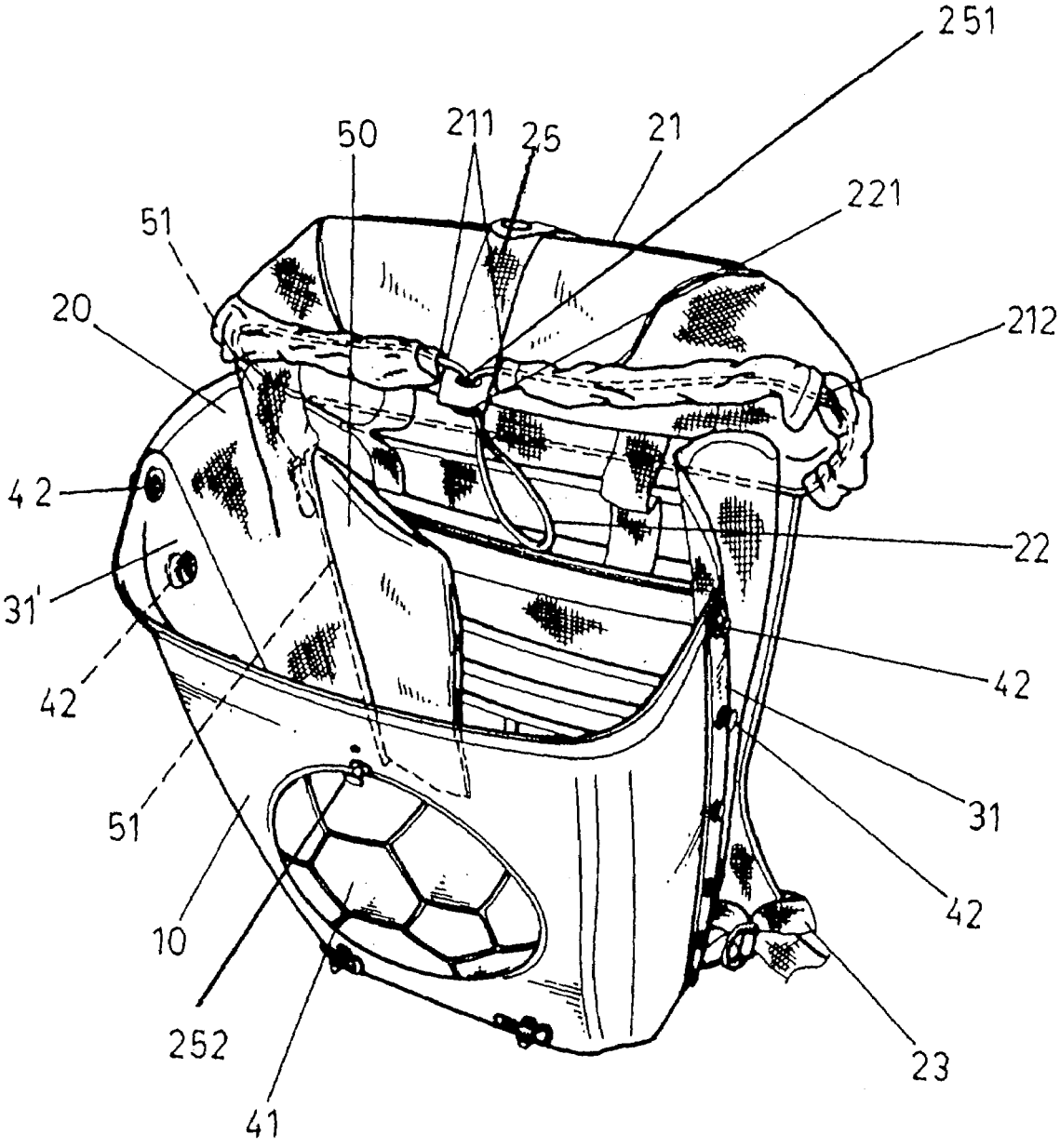
FIG. 1 is a perspective view of the bag of the present invention.
Figure 2:
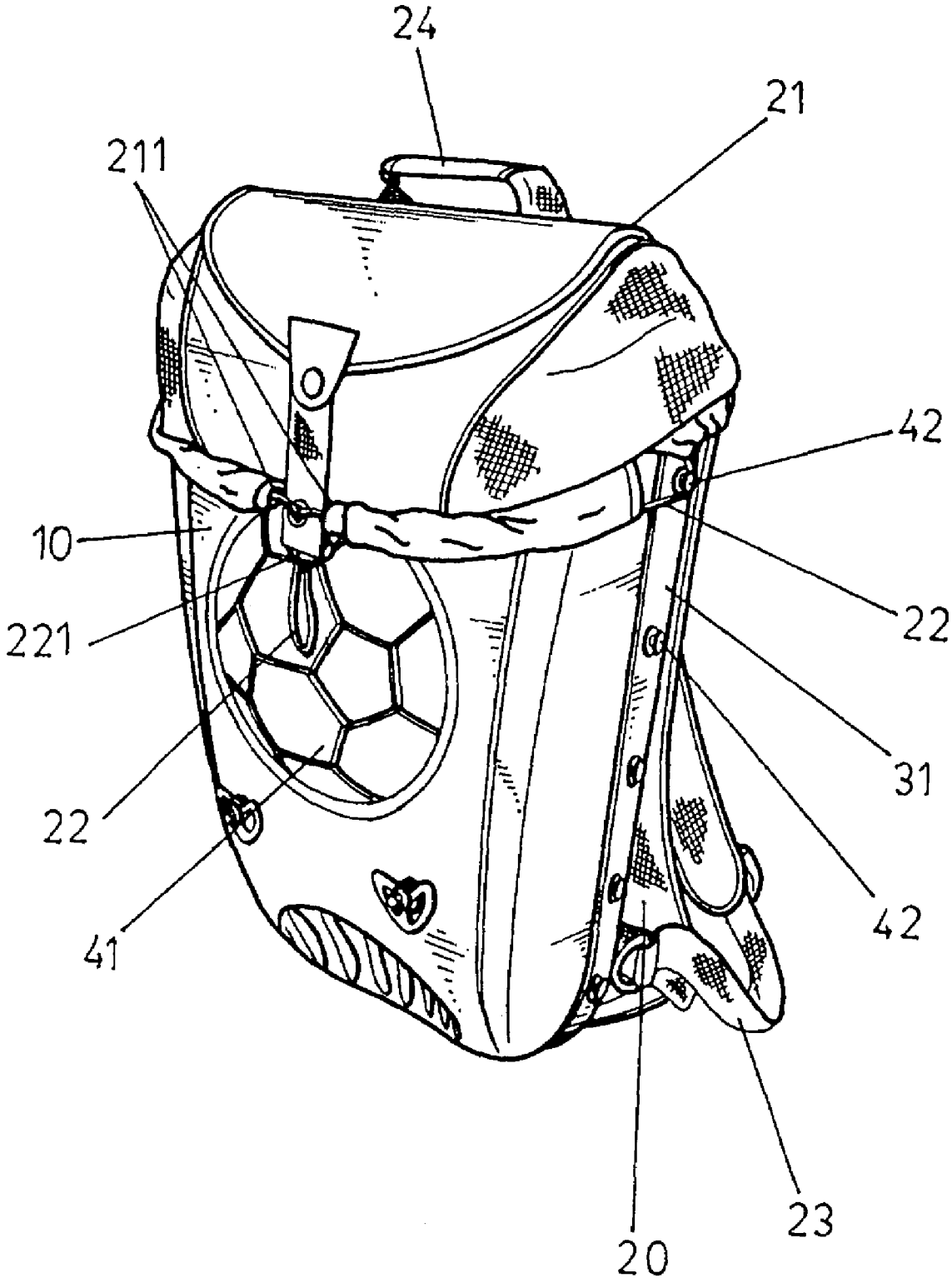
FIG. 2 is a perspective view of the present invention where the cover of the bag is closed.
Figure 3:
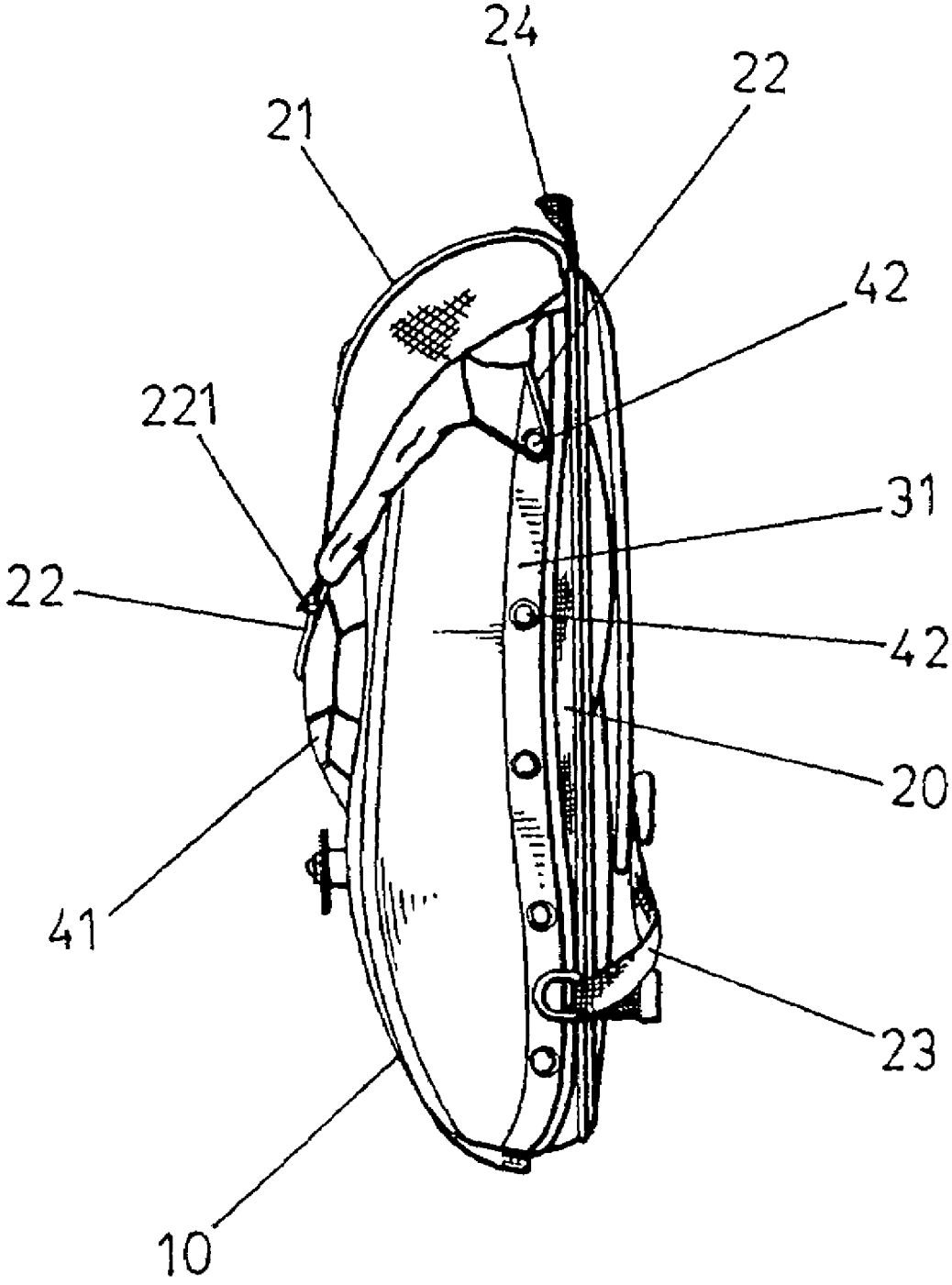
FIG. 3 is a lateral view of the present invention
Figure 4:
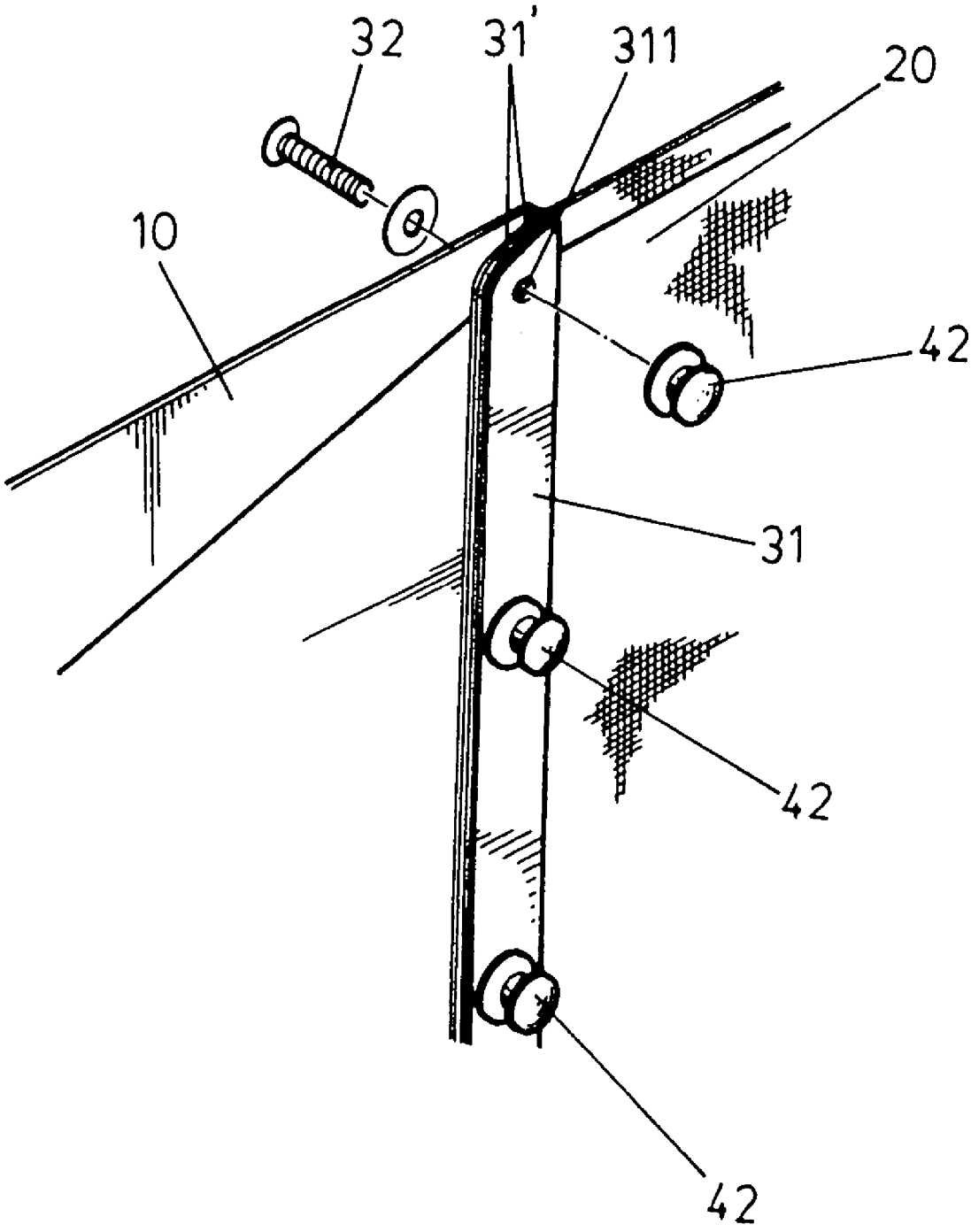
FIG. 4 is an exploded perspective view of the present invention.

With reference to FIGS. 1 and 3, the bag of the present invention is illustrated. The bag is formed by connecting a hard casing 10 and a soft enclosure 20. The soft enclosure 20 has belts 23. A soft enclosure 20 is extended with a cover 21 for covering the hard casing 10 and a handle 24. Referring to FIG. 4, a surface of the hard casing 10 is formed with a decoration 41 so that the bag has a beautiful appearance and increasing a receiving space. The connections of the hard casing 10 and soft enclosure 20 are formed at two sides of the bag. The connections are enclosed by connectors 31, 31' which are locked by buckles 42.

Figure 5:
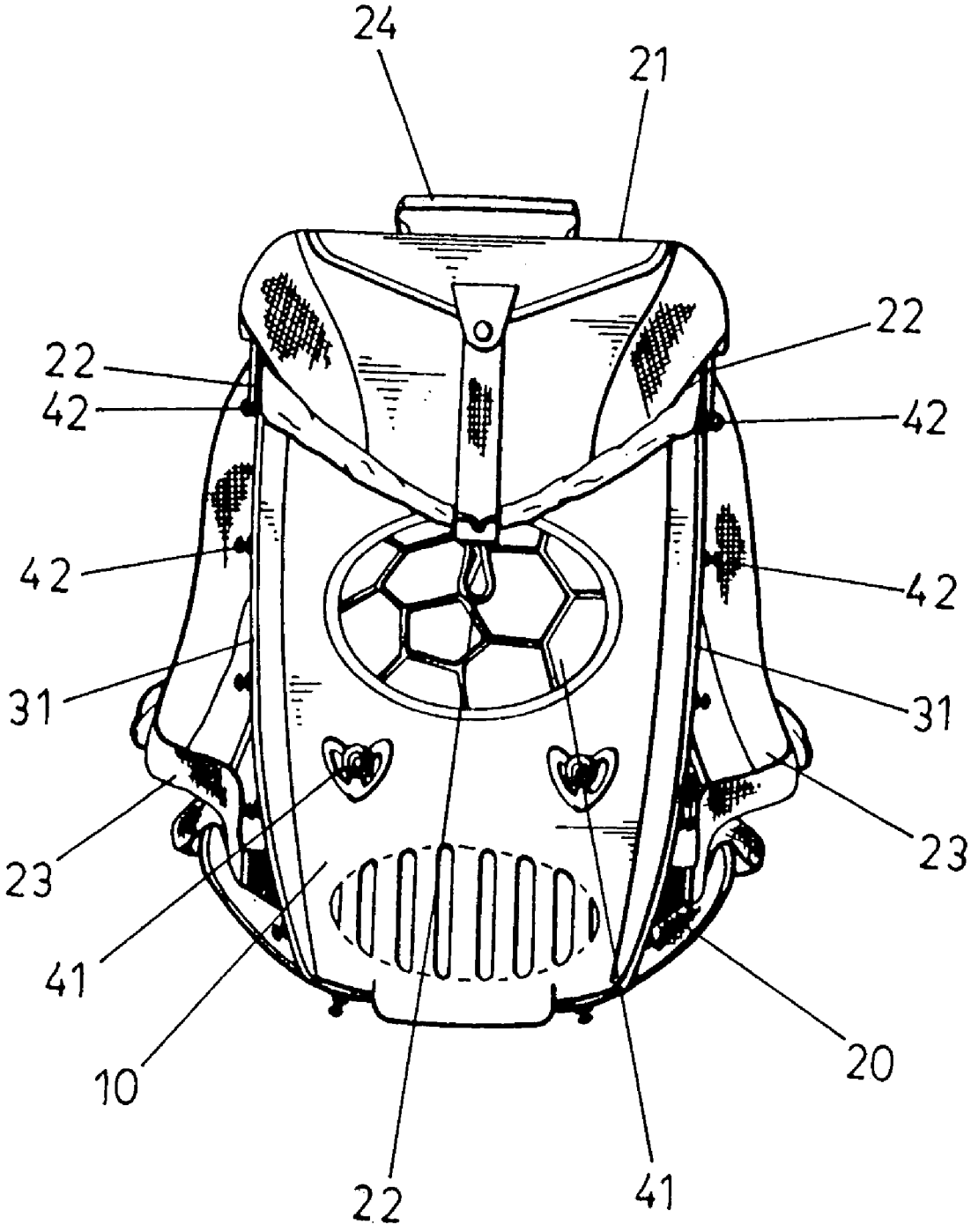
FIG. 5 is a front view of the present invention, where the cover of the bag is closed.

The connector 31 is at an outer layer of the bag and connector 31' is at an inner side of the bag. The connectors 31 are made of leather materials and the connectors 31' are made of metals. The cover 21 is installed with a first insertion portion 211 at a front surface of the bag and second insertion portions 212 at two sides of the bag. A band 22 passes through the first insertion portion 211 and second insertion portions 212 and then winds around an edge of the cover 21. A strip 25 has one end fixed to the cover 21 and another end has a hole 251. A retaining ring 221 is installed at a position that the band 22 is out of the first insertion portion 211. Thereby, the band 22 out of the first insertion portion 211 and second insertion portions 212 firstly passes through the hole 251 of the strip 25 and then is tightened by the retaining ring 221. Two ends of the band 22 are buckled to first and second buckles 42, as shown in FIGS. 3 and 5. Thereby, the cover 21 is firmly secured to the hard casing 10 so as to prevent objects in the bag from falling down.

A front outer side of the enclosure has a buckle button 251 so that when the cover 21 covers the opening of the enclosure 20, the buckle 252 can be further buckled to the hole 252 so as to fix the cover 21 to the enclosure 20. The band 22 also passes through the hole 251 and then is confined by the retaining ring 221.

Moreover, in use, a plurality of buckles 42 are buckled to the connector 31 so that the band 22 can be buckled to the buckles 42 of different levels and thus the tightness of the cover 21 securing to the hard casing 10 is adjustable according to the objects in the bag. Besides, as shown in FIG. 1, in the present invention, the inner side of the soft enclosure 20 can be installed with a hidden bag 50 for receiving valuable objects.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A safety bag with a firm structure formed by connecting a hard casing and a soft enclosure so as to form a bag body with an opening; the soft enclosure having belts for being carried on the shoulders of users; a cover extending from the soft enclosure for covering the opening; the connections of the hard casing and soft enclosure being formed at two sides of the bag and being enclosed by connectors;

wherein the connectors are installed with a plurality of buckles; the cover is installed with a first insertion portion at a front surface of the bag and a second insertion portion at two sides of the bag; a band passes through the first insertion portion and second insertion portion and then winds around an edge of the cover; a strip having one end fixed to the cover and another end having a hole; a retaining ring is installed at a position that the band is out of the first insertion portion; thereby, the band out of the first insertion portion and second insertion portion firstly passes through the hole of the strip and then is tightened by the retaining ring; two ends of the band are buckled to selective two buckles of the plurality of buckles; thereby, the cover is firmly secured to the hard casing so as to prevent objects in the bag from falling down; and a front outer side of the enclosure has a buckle button so that when the cover covers the opening of the enclosure, the buckle button can be further buckled to the hole so as to fix the cover to the enclosure; further the band also passes through the hole and then is confined by the retaining ring;

wherein the band is capable of being buckled to the buckles of different levels so that the tightness of the cover securing to the hard casing is adjusted according to the objects in the bag;

wherein the inner side of the soft enclosure is installed with a hidden bag for receiving valuable objects; the hidden bag is fixed at one lateral side of the enclosure;

wherein a top of the soft enclosure is installed with a handle;

wherein a first connector is at an outer side of the bag and is made of leather materials, and a second connector is at an inner side of the bag and is made of metals.

* * * * *